US007131472B2

(12) United States Patent
Müller

(10) Patent No.: US 7,131,472 B2
(45) Date of Patent: Nov. 7, 2006

(54) METHOD FOR THE PRODUCTION OF A THREE-DIMENSIONAL, FLEXIBLY DEFORMABLE SURFACE ELEMENT

(76) Inventor: Achim Müller, Max-Sachs-Strasse 32, D-1157 Dresden (DE)

( * ) Notice: Subject to any disclaimer, the term of this patent is extended or adjusted under 35 U.S.C. 154(b) by 279 days.

(21) Appl. No.: 10/477,649

(22) PCT Filed: May 17, 2002

(86) PCT No.: PCT/DE02/01892

§ 371 (c)(1),
(2), (4) Date: Nov. 13, 2003

(87) PCT Pub. No.: WO02/092302

PCT Pub. Date: Nov. 21, 2002

(65) Prior Publication Data

US 2004/0144448 A1 Jul. 29, 2004

(30) Foreign Application Priority Data

May 17, 2001 (DE) ..... 101 24 913

(51) Int. Cl.
*B27D 1/00* (2006.01)
*B27G 11/00* (2006.01)

(52) U.S. Cl. ..... 144/351; 144/345; 144/350

(58) Field of Classification Search ..... 144/351, 144/345, 341, 348, 350, 355, 344, 359, 363; 156/257, 268, 154; 427/289, 290, 291, 331, 427/207.1, 368
See application file for complete search history.

(56) References Cited

U.S. PATENT DOCUMENTS 4,731,140 A * 3/1988 Yontrarak ..... 156/154
5,456,781 A * 10/1995 Tingley ..... 156/154
5,665,190 A * 9/1997 Sansano Sanz ..... 156/154
5,772,830 A * 6/1998 Hasegawa ..... 156/292
6,066,367 A * 5/2000 Nishibori ..... 427/274
6,701,984 B1 * 3/2004 Lamontagne et al. ..... 144/347

FOREIGN PATENT DOCUMENTS

| | | |
|---|---|---|
| DE | 838361 | 5/1952 |
| DE | 271670 | 9/1999 |
| EP | 1 392 481 | 5/2002 |

* cited by examiner

*Primary Examiner*—Bena Miller
(74) *Attorney, Agent, or Firm*—Robert W Becker & Associates; Robert W Becker

(57) ABSTRACT

A method of producing a three-dimensionally, flexibly deformable surface element of wood or wood composite material is provided. A workpiece is used having a thickness at least 5% greater than the thickness of a three-dimensional surface element that is to be prepared. Narrow, spaced-apart grooves are introduced into the workpiece and have a depth greater than or the same as the thickness of the three-dimensional surface element yet less than the thickness of the workpiece. The portion of the workpiece that is greater than the thickness of the surface element is separated or otherwise processed from the remainder of surface element in such a way that at least temporarily no fixed cohesion of portions separated by the grooves exist. Prior to, during of after separation from the workpiece the portions thereof separated from one another by the grooves are fixed to one another and/or to a substrate by a transverse connection or bond.

25 Claims, 3 Drawing Sheets

METHOD FOR THE PRODUCTION OF A THREE-DIMENSIONAL, FLEXIBLY DEFORMABLE SURFACE ELEMENT

BACKGROUND OF THE INVENTION

The invention relates to a method of producing a three-dimensionally, flexibly deformable surface element of wood or wood composite material (3D surface element), which is suitable for producing layered three-dimensionally formed, preferably dish-shaped, parts, or for coating other, three-dimensionally formed components of various materials.

SUMMARY OF THE INVENTION

The production of a three-dimensionally, flexibly deformable surface element is described in DD 271 670 B5. According to it, a surface element, such as a sheet of wood veneer or plywood, is guided through a scoring blade frame and in so doing is cut into strips over the entire thickness of the veneer in order to enable their displaceability in the surface, which is necessary for a three-dimensional deformation. During this cutting, very high cutting forces result that rapidly tear up the wood veneer as it is pulled through the frame. This danger of breakage becomes extremely high if the wood fibers are not exactly parallel to the direction of the strips. Thus, this method is unreliable. Pursuant to a further variant, a surface element is cut into strips via a stamping cut or roller cut, whereby, however, comparable problems as with the cutting via a scoring blade frame result.

Pursuant to one variant, two surface elements are glued together in a crossed manner, and thereafter are respectively cut into strips from both sides via roller blades, whereby the thus resulting surface element is three-dimensionally deformable. Although the cutting does not lead to breakage of the strips during the processing phase, since the strips are protected by the surface element disposed therebelow, none the less this type of cut is directed to the doubling of two surface elements, which is desired only in certain cases of processing of three-dimensionally deformable surface elements. The V-shaped grooves that result during the cut are open toward the outer side, and are thereby made prominent, which is not desired for formed parts produced therefrom. Finally, with roller blades that are disposed closely together, such as also with the aforementioned scoring blade frame, the cutting leads to extreme cutting forces.

A further variant in DD 271 670 provides for the measuring-off of surface elements from a veneer block that is comprised of superimposed veneers. Although in so doing none of the aforementioned reliability problems occur, however the surface element does not have a customary wood image, which is generally desired for visible surfaces, but rather demonstrates a layer structure. Furthermore, the width of the surface element that is produced is narrowly limited due to the process.

DE 32 09 300 A1 describes the introduction of notches into a veneer edge via special saws. The objective here is merely the improvement of the 2D flexibility (bendability) transverse to the notch and not the displaceability of parts of the veneer, which in this way would not even be possible. Similarly, in DE 31 18 996 A1 such notches, possibly in cooperation with a carrier layer that is not notched, are proposed, as a result of which the folding of the veneer is to be facilitated.

For the stabilization of veneers that are to be pressed onto a carrier material, a series of approaches are offered, according to which films or lacquer layers are applied to the veneer.

One example is DE 27 43 231 A1, where a support layer having a high tensile strength is applied to the veneer. With all these approaches, however, the objective is the stabilization of the continuous veneer surface, and not the simultaneous guarantee of a shift deformability.

The object of the invention is the provision of a method of producing a three-dimensionally, flexibly deformable surface element of wood or wood composite material for the production of layered, three-dimensional formed parts or for coating three-dimensional formed parts, according to which the surface element, during and after its production and further processing, is not susceptible to the danger of damage or destruction due to limited material properties (danger of breakage, inclination to tear). In particular, the technological reliability problems during the production of a three-dimensionally, flexibly deformable surface element of wood or wood composite material pursuant to DD 271 670 B5 is to be eliminated and, with a simultaneously satisfactory quality of the product, a high effectiveness of the manufacture is to be ensured.

The method of producing a three-dimensionally, flexibly deformable surface element of wood or wood composite material is realized in the following steps:

Starting material is a workpiece that is comprised of wood, layered wood (laminated wood) or a composite of wood and one or more further surface materials, and this workpiece is at least 5% thicker than the 3D surface element that is to be produced.

Introduced into this workpiece are narrow grooves, preferably along the wood fiber direction, that are spaced 0.1 to 10 mm apart, in special cases up to 100 mm. The respective groove depth is greater than or the same as the thickness of the 3D surface element, and less than the thickness of the workpiece.

Subsequently, that portion of the workpiece that surpasses the thickness of the 3D surface element that is to be produced is separated or otherwise processed from the thereby remaining 3D surface element in such a way that at least temporarily no fixed cohesion of the portions (strips of the future 3D surface element) separated by the grooves exists any longer.

The portions of the workpiece separated from one another by grooves are subsequently, and preferably prior to the separating-off of the 3D surface element, glued together by a transverse connection or bond.

By means of the grooves, the 3D surface element is divided into strips having a width of 0.1 to 10 mm (100 mm), and is thus 3D deformable pursuant to DD 271 670 B5 after the release of the reversible transverse connection.

The inventive grooves are preferably V-shaped and have an opening angle $\alpha$ of up to 15 degrees and are introduced by means of scoring blades or roller blades that are preferably moved along the direction of the fibers. In this connection, the relative movement blade-to-workpiece is critical. To achieve the small groove spacings or intervals, the blades, which for stability reasons are delimited downwardly in the thickness, are disposed in two or more rows in an offset manner one after the other. This offset furthermore has the advantage that the displacement of the material that is to be processed during the penetration of the blades can be respectively distributed over the multiple groove width, thereby reducing the cutting forces of the blades.

In place of scoring or roller blades, it is also possible to use stamping blades that are moved transverse to the surface of the workpiece, and which for the introduction of a number of grooves penetrate into the material in a periodically and/or locally offset manner.

Alternatively, the grooves, starting at an angle of $\alpha=5$ degrees, can also be formed in a chipping manner via appropriate saws or milling tools. This is particularly advantageous with fragile materials, since here the cutting forces are less than with the above described non-chipping cut. The grooves can also have a profile that deviates from the V shape.

Separating processes such as laser or water jet cuts are also possible for introducing the grooves. The particular advantages here are the high operating speed as well as the elimination of resharpening of cutting tools.

The decisive advantage of the inventive groove, in comparison to the continuous separation of the strips described pursuant to DD 271 670, is in the stability of the workpiece achieved by the remaining connection or bond of the strips, especially in the phase of the strip cut, so that even wood having fibers at an incline can be processed without any problem.

After the grooves are introduced into the workpiece, preferably, however, prior to the separating-off of the material that extends beyond the thickness of the 3D surface element that is to be produced, there is effected the production of the transverse connection or bond of the grooved portions.

Particularly advantageous is the pressing of a filling adhesive, which is possibly treated with further materials, such as fire retarding or UV stabilizing substances, into the V-shaped grooves, which adhesive, after the partial or complete, yet reversible solidification, ensures the connection or bonding of material in the grooved portion until further processing takes place. The transverse connection can also be produced, preferably prior to the separating-off of the material, by application of a material that is capable of shift deformation and/or is reversible, such as individual filaments, woven material, a fleece, a film or an adhesive layer, either instead of the pressed-in adhesive or in addition thereto, such as a partial reinforcement of the 3D surface element at portions that are highly stressed during the later 3D deformation.

The mentioned variance of the transverse connection or bond can also be realized after the separating-off of the described material, whereby between the phase of the separation and the establishment of the transverse connection, a surface-obtaining guidance of the strips must be effected.

The transverse connection via adhesive in the V grooves permits with a 3D element, during the phase of the later 3D deformation, a shift deformation of the strips without in so doing having the seams between the strips open. This shift deformability is achieved by binder material that at standard conditions is set in conformity with elastic/plastic, by resoftening (reactivation) as a consequence of selected effects, or by 3D deformation that is chronologically coordinated in such a way that the transverse connection is final-solidified only after this deformation by an appropriate reaction of the binder material.

A transverse connection by means of a material that is applied enables the shift deformation of the strips by its shift deformability that is due to the material, and/or by the deformability of the adhesive layer.

If the workpiece is comprised of layered wood, the stability of the strips of the separated-off 3D surface element, in addition to the described transverse connection, is increased by the isolating effect of the layers in such a way that even extremely inclined fibrous or fragile starting material, such as mahogany or grained wood, can be reliably processed to form a 3D surface element. This isolating effect results with wood plies (veneers) that are layered appropriately transverse to one another, but also with plies that are layered in parallel relative to the direction of the wood fibers, since practically always a deviation from the assumed fiber direction and hence a certain criss-crossing occurs.

The same isolating effect results with the use of a surface material that is used in addition to the layering, such as a plastic film or a fleece.

The production of the 3D surface element by separating off remaining material is effected, in the event that the starting workpiece is only slightly thicker than the 3D surface element (e.g. a veneer piece), preferably by grinding the remaining material off. In this way, the grooves are continuous, and the desired 3D deformability is achieved. A grinding of the surface for 3D surface elements of grained or pared veneer, when used as a cover ply in a formed part, is necessary in any case, so that this step signifies no additional expense. Instead of the grinding, other removal and thereby smoothing processes, such as planing via scrapers, or longitudinal blades (finishing), are also possible. The already produced transverse connection or bond between these strips stabilizes the workpiece during the separating process and makes it possible to handle the finished 3D surface element just like conventional wood veneer.

A sealing effect results when the grooves are filled with adhesive, thereby avoiding the danger of glue penetrating through during the later joining together of the plies, as well as the danger of the capillary penetration of liquid surface coating materials such as lacquers and pickling materials into the seams on the finished formed part that are solidified or set after the 3D deformation. As a consequence, the undesired optical accentuation of the seams is precluded. The solidified seams furthermore increase the strength and in particular the torsional stiffness of the finished formed part.

If the workpiece is considerably thicker than the 3D surface element that is to be produced (e.g. a solid wood scantling), the separating-off of the remaining material is provided as a block. For a better understanding, one should here talk about the separating-off of the 3D surface element from the block, but the operating principle remains the same. This can be effected by conventional separating processes such as sawing, however advantageously by a chipless separating-off, such as by longitudinal blades in the manner of veneer manufacture, e.g. with a finishing machine. The separating-off of 3D surface elements from this block can be repeated with respectively renewed grooving until the block is used up. During the repeated grooving one must pay attention that the grooving tools, in a manner aligned with the respective preceding step, enter into the portions of the groove that lie beyond the 3D surface element. Since during the finishing a very smooth surface results, grinding is here no longer necessary. The transverse connection of the strips here has the same advantages as with the separating-off by means of grinding.

The separating-off of the material that extends beyond the thickness of the 3D surface element can also be effected by pulling or tearing off a layer that is provided therefor and is secured only with a contact adhesive. Such a layer is preferably comprised of plastic and can possibly be reused a number of times after an appropriate processing. However, it can also remain as a protective film during the subsequent transport and storage until the 3D surface element is further processed, which is advantageous with particularly valuable materials such as grained veneer.

Instead of separating off the material, e.g. a plastic film, that extends beyond the thickness of the 3D surface element, a softening of the material, e.g. by melting, can also be undertaken, which also leads to a desired displaceability of the strips. This softening is undertaken parallel to the reversal of the possibly additionally utilized transverse connection. The particular advantage of this is the possibility of being able to use this plastic film simultaneously for the gluing of the 3D surface element with, for example, a carrier formed part or for the surface coating of the later outer surface of the formed part.

It is advantageous to adjust the moisture content of the wood of the workpiece or the 3D surface element. For example, the 3D surface element can, preferably prior to its inventive production, be brought to a wood moisture content of greater than 10%, preferably to approximately 15%–22%, whereby in addition to the water portion that is not in moisture equilibrium, a fungus-inhibiting material, such as formaldehyde, is introduced. In this state, the 3D surface element is capable of being stored without being subjected to fungus.

A further advantage is that the 3D surface element is so much more 3D deformable since the individual strips can be bent in smaller radii than is the case at normal equilibrium moisture. This effect can be further increased if in addition a heating takes place prior to the 3D deformation.

The high water content is reduced to the conventional amount during a subsequent hot-pressing of the 3D formed part. Similarly, in so doing the formaldehyde content is reduced to an acceptable level. As a consequence of the thus achieved, improved fusibility of the 3D surface element, cracks or gaps that might occur during the pressing process are effectively closed.

If the increased wood moisture already exists prior to the production of the 3D surface element, the cutting forces required therefor are reduced, which is associated with reduced machine wear.

Pursuant to a further, advantageous variant, a fire retardant is added to the additionally introduced water.

Instead of the increased moisture content of the wood, the 3D surface element can also be pretreated with wood plasticizing material such as ammonia. This results in advantages that are comparable to those of the described moisture treatment.

For selected applications, the 3D surface element is treated with a known impregnating resin. Such a resin penetrates into the interior of the wood structure, but also wets the surface of the strips of the 3D surface element. The resin is such that it becomes fluid during the heating that is to be effected prior to the 3D deformation, and thus enables the shifting of the strips of the 3D surface element. In addition to the improvement of the resistance to water that is known for impregnated wood, the reversible gluing of the strips of the 3D surface element that is effected with the impregnation is advantageous.

Inventive surface elements that were produced from grooved and ground veneer are preferably used as decorative cover ply veneer during the manufacture of laminated wood formed parts for chairs, seat forms, interior structures for caravans or ships, cases or boxes, containers such as trunks, bins or boxes, musical instruments, housings for e.g. electronic devices such as loud speakers or televisions, toys, sporting devices. Such surface elements are also suitable as coating material for formed parts of other materials for the aforementioned applications. Furthermore, there are further possibilities of use for the coating of front portions of pieces of furniture of e.g. chipboard or fiberboard such as 3D doors or circular tabletop profiles (3D "borders"), of inner claddings of automobiles or control parts such as steering wheels of plastic or metal parts, or of inner claddings of airplanes of lightweight plastic components. For areas that are particularly vulnerable to fire in vehicle construction, especially in the construction of ships and aircraft, the use of fire retardants in the transverse connection adhesive, or also in a plastic film used for the coating, is advantageous. Surface elements having a film that can be pulled off or also useable as an adhesive are furthermore favorably useable for the occasional processing, especially in the trades.

BRIEF DESCRIPTION OF THE DRAWINGS

The invention will be subsequently explained in greater detail with the aid of selected embodiments and is illustrated in the pertaining drawings, in which.

DESCRIPTION OF PREFERRED EMBODIMENTS

Figure 1:
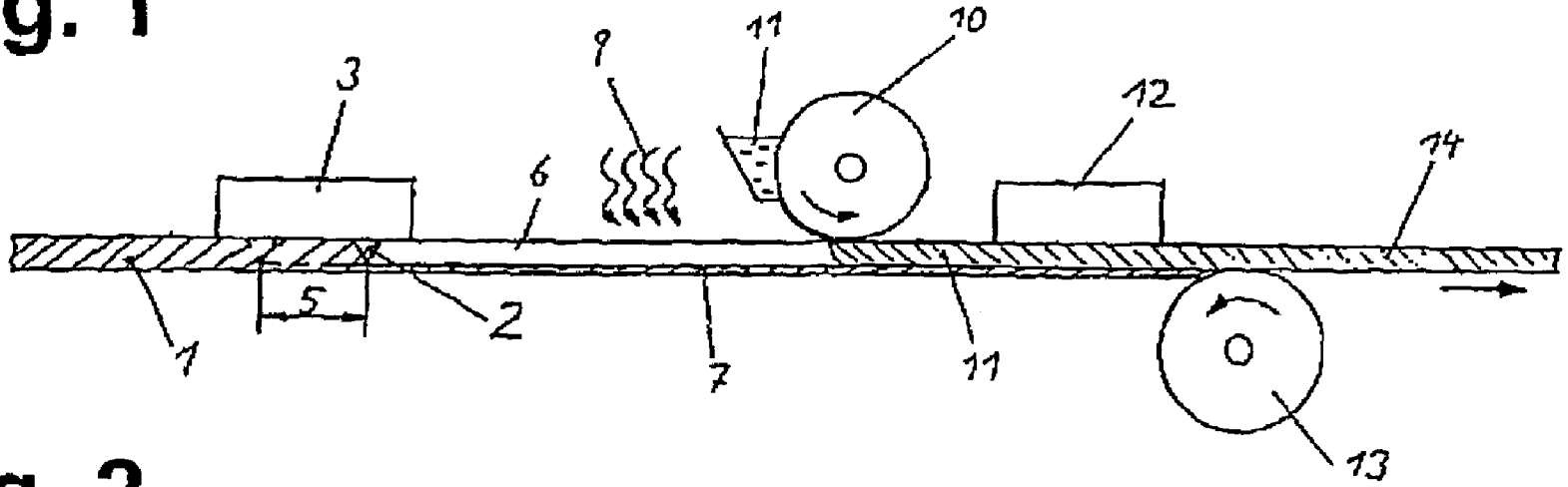
FIG. 1: An arrangement for the production of a 3-dimensional, flexibly deformable surface element of beech veneer.
Figure 2:
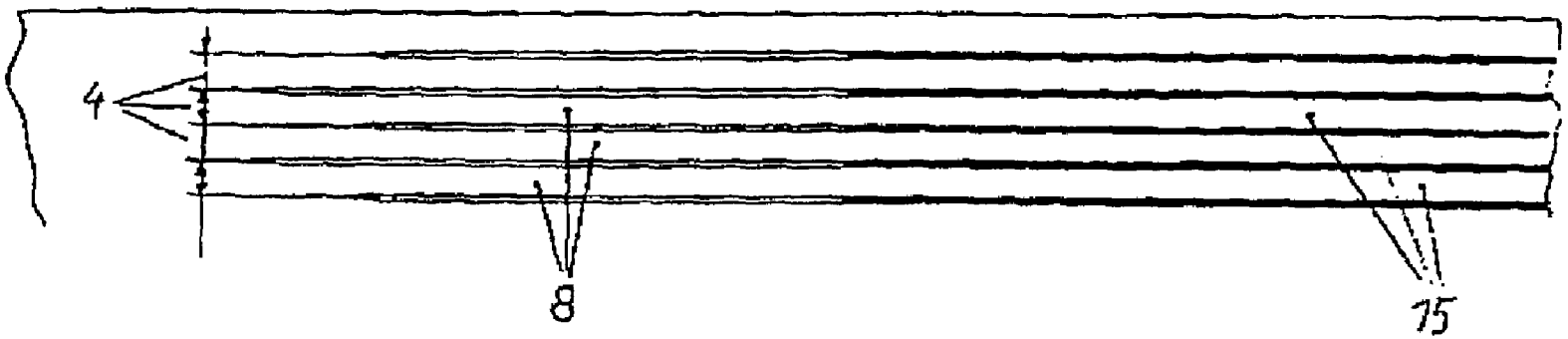
FIG. 2: An arrangement pursuant to FIG. 1 in a simplified plan view without illustration of the operational elements above the surface element.
Figure 3:
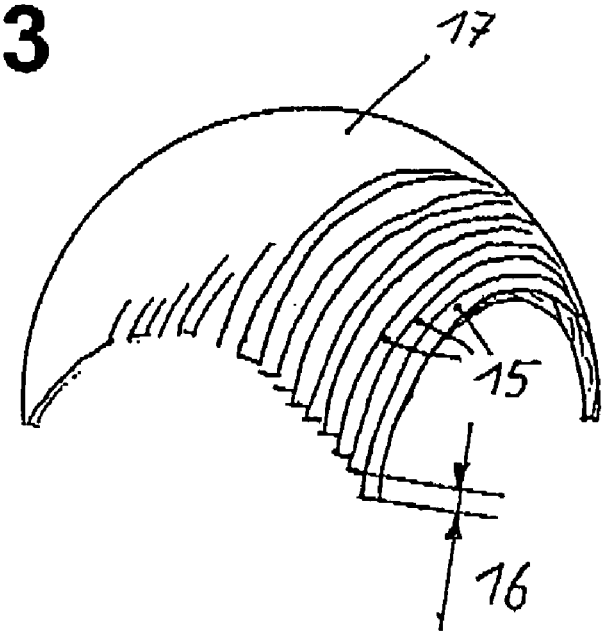
FIG. 3: A 3D deformable surface element for the production of a musical instrument formed part.

Embodiment 1 (FIGS. 1–3):

A beech veneer (1) having a thickness of 1.2 mm passes through a scoring blade frame, the blades (2) of which project 1 mm out of the blade holder (3). Position (4) is the lateral blade spacing of 1.0 mm, position (5) the blade offset in the working direction of 6 mm. In this connection, 1 mm deep grooves (6) that are spaced 1 mm apart are cut into the veneer (1). The remaining 0.2 mm form the temporary connection (7) of the grooved portions. If the fiber direction of the veneer (1) deviates from the groove direction, the wood fibers of the connection (7), which fibers thereby extend at an incline to the grooves (6) thus have a strengthening effect for the overall workpiece (1), so that a breaking of the portions (8) between the grooves, which portions are cut at an incline to the fibers and form the later strips, due to the effect of the very high cutting forces, is avoided.

As a result of the blade offset (5), the blades (2), which are introduced into the workpiece (1), are respectively laterally spaced from one another by 2 mm, and thus sufficient material from the workpiece (1) is present in order to accommodate the volume displaced by the blades (2) by compaction.

The now grooved veneer subsequently passes through a heat zone (9), where it is brought to a temperature of 95° C. and thereafter passes through a glue roller (10) that presses a fusion or hot-melt-type adhesive (11) into the grooves (6) at a temperature of 160° C. The hot-melt-type adhesive (11) hardens or sets as it passes through a cooling zone (12).

Thereafter, the aforementioned temporary connection (7), including a safety margin of 0.1 mm, is ground off by a grinder (13), and there remains a 0.9 mm thick, three-dimensional, flexibly deformable surface element (14), the strips (15) of which are held together by the hot-melt-type adhesive. After its reactivation (heating), the adhesive (11)

permits the displacement (16) of the strips (15) and hence the 3D deformation of the overall surface element (17). After its solidification, the hot-melt-type adhesive seals the seams between the strips for the formed part produced from the 3D surface element, and thereby prevents the penetration of liquid surface material, as a result of which the optical accentuation of the seams is avoided. Furthermore, the strength and rigidity of the formed part is increased in this manner.

The 3D surface element is used for producing a formed part of a musical instrument.

Figure 4:
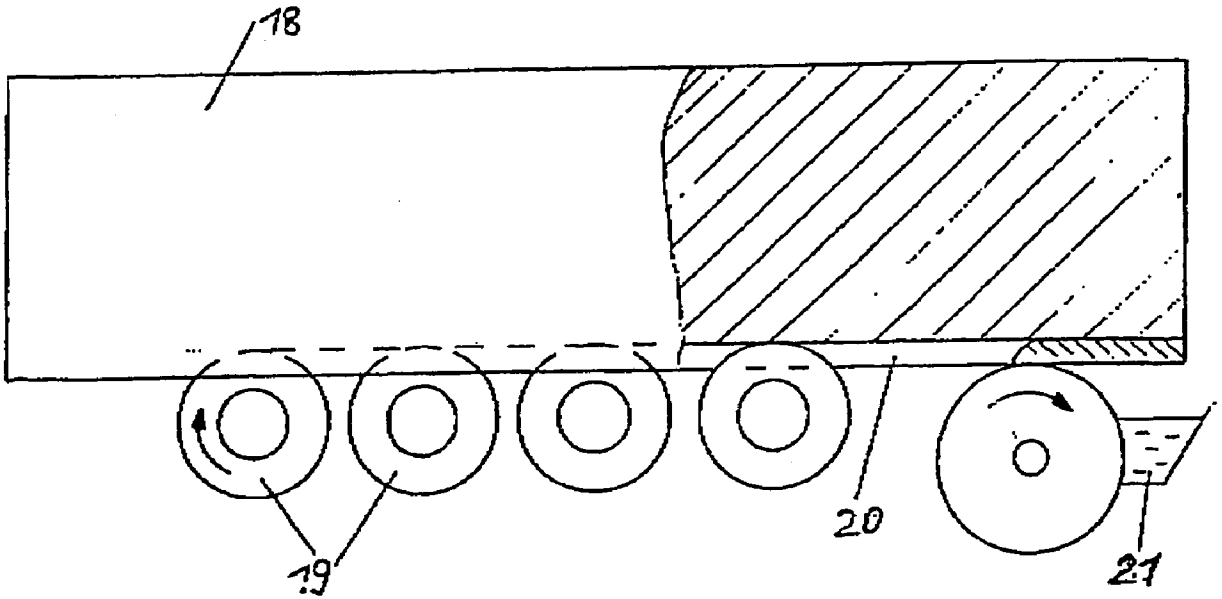
FIG. 4: An arrangement for the partial production of a 3-dimensional, flexibly deformable surface element from a scantling.
Figure 5:
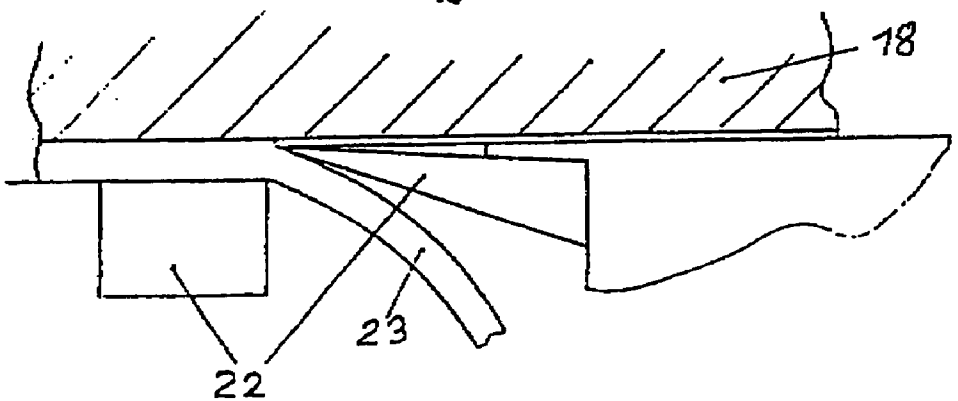
FIG. 5: A portion of a finishing machine for the further processing of a scantling handled pursuant to FIG. 4.

Embodiment 2 (FIGS. 4 and 5):

A cantle (18) of cherry wood having the dimensions 100×250×1500 $mm^3$ passes through four roller cutter spindles, each of which contains roller cutters (19) that are spaced 1.2 mm apart, wherein the roller cutters are respectively laterally offset by 0.3 mm, so that the thus produced grooves (20) are spaced 0.3 mm apart. The roller cutters or blades penetrate 0.4 mm deep, so that grooves having a depth of 0.4 mm are cut into the cantle. Subsequently, PU adhesive dispersion (21) is pressed into the grooves (20) and are rapidly hardened due to the low adhesive volume in the grooves. The cantle thereafter passes through a finishing machine (22) in which, from the grooved side, a 0.3 mm thick, 3-dimensional, flexible surface element (23) is measured off. This process is repeated as often as necessary until the cantle is used up. A lateral abutment member, as well as pressure rollers on the opposite side, during repeated measuring-off ensure that the grooves respectively extend in an aligned manner.

The 3D surface element is further processed for the production of a very 3-dimensionally shaped case or box.

Figure 6:
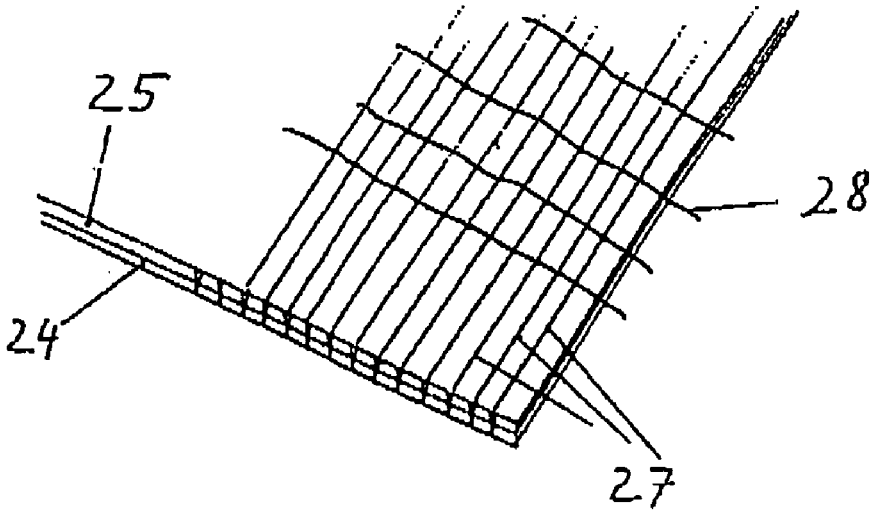
FIG. 6: A 3D surface element of laminated wood having a glass fiber fusible filament reinforcement.

Embodiment 3 (FIG. 6):

A walnut-grained veneer (24) having a thickness of 0.6 mm is glued via a polyurethane adhesive onto a beech pared veneer (25) having a thickness of 0.6 mm. The further processing of the thus resulting 1.2 mm thick laminated wood is effected analogous to that of example 1, whereby, however, instead of the scoring blade frame, a multi-blade circular saw having circular saw blades that are 1 mm thick and are sharpened at an angle of 7° for introducing the grooves (27) into the measured-off portions otherwise mentioned in example 1. The saws subject the laminated wood to little stress, thus avoiding a destruction of the grained veneer during the cutting process. Furthermore, the beech veneer stabilizes the otherwise very fragile grained veneer not only during but also after the further processing, such as during the pressing-in of the hot-melt-type adhesive and the grinding to a thickness of 0.9 mm. Finally, in the central portion of the thus resulting 3D surface element, known glass fiber fusible filaments (28) are glued onto the beech veneer transverse to the direction of the strips at intervals of 20 mm. During later 3-dimensional deformation, these filaments prevent a possible pulling apart of the seams between the strips in the region of extreme transverse tensile stresses that are caused by the deformation. Further advantages correspond to those of example 1.

The surface element is used to produce a very profiled front component of a piece of container furniture.

Embodiment 4:

A composite material is comprised of a 0.5 mm thick birch-grained veneer, on the upper surface of which is glued a 0.5 mm thick soft pvc film via acrylic contact adhesive. Glued onto the underside of the birch-grained veneer, via a completely hardened polyurethane adhesive, is a 0.4 mm thick polyacrylate film. This composite material is provided with grooves from the underside similar to the situation in example 1 via scoring blades, with the grooves being 1 mm deep and being spaced apart by 0.8 mm. Similar to example 3, the polyacrylate film seals off the birch-grained veneer and thus stabilizes it. As in example 1, the grooves are subsequently filled by means of a hot-melt-type adhesive. Thereafter, the pvc film is withdrawn from the composite. The contact adhesive is selected such that it merely effects a tacky adhesion that can be released with moderate force, whereby the contact adhesive is entirely removed from the veneer. In this way, a 3-dimensional deformable surface element results. The surface elements can optionally be stored between the forming of the grooves and the withdrawal of the pvc film. In this connection, the pvc film assumes the function of a protective film. If necessary, the adhesive can be cleaned from the pvc film so that the latter can then be reused.

The specification incorporates by reference the disclosure of German priority document 101 24 913.6 filed May 17, 2001 and PCT/DE02/01892 filed May 17, 2002.

The present invention is, of course, in no way restricted to the specific disclosure of the specification and drawings, but also encompasses any modifications within the scope of the appended claims.

The invention claimed is:

1. A method of producing a three-dimensionally, flexibly deformable surface element of wood or wood composite material for producing layered, three-dimensional formed parts or for coating three-dimensional formed parts, said method including the steps of:

providing a workpiece of wood, laminated wood, or a composite of wood and one or more further surface materials, wherein said workpiece has a thickness that is at least 5% greater than a thickness of a three-dimensional surface element that is to be produced;

introducing narrow grooves that are spaced from one another into said workpiece, wherein each of said grooves has a depth that is greater than or the same as the thickness of said three-dimensional surface element yet less than the thickness of said workpiece;

subsequently separating or otherwise processing the portion of said workpiece that is greater than the thickness of said three-dimensional surface element from the remainder of the three-dimensional surface element in such a way that at least temporarily no fixed cohesion of portions separated by the grooves exists; and prior to, during or after said separating or otherwise processing step, fixing the portions of said workpiece that are separated from one another by the grooves to one another and/or to a substrate by a transverse connection or bond.

2. A method according to claim 1, wherein said grooves are introduced parallel to a direction of fibers of said wood.

3. A method according to claim 1, wherein said grooves are introduced at a spacing of 0.1 to 100 mm.

4. A method according to claim 1, wherein said grooves are introduced in a V-shaped manner.

5. A method according to claim 4, wherein an opening angle of said V-shaped grooves is ≧0° and ≦15°.

6. A method according to claim 5, wherein said grooves have an opening angle of ≧5° and ≦15° and are formed via circular saws, side-milling cutters or profile cutters.

7. A method according to claim 1, wherein said grooves are introduced via scoring blades or roller blades that are moved parallel to a direction of fibers.

8. A method according to claim 1, wherein said grooves are introduced via stamping blades that are moved transverse to a surface of said workpiece.

9. A method according to claim 1, wherein said grooves are formed via a laser or water jet cutting device.

10. A method according to claim 1, wherein said portions of said workpiece that are separated from one another by said grooves are fixed by said transverse connection prior to said separating-off of said three-dimensional surface element.

11. A method according to claim 10, wherein said transverse connection is formed by applying a shift deformable and/or reversibly set material.

12. A method according to claim 11, wherein said material is an adhesive in the form of a heat-reactive adhesive, a light-resistant adhesive or a fire-retarding adhesive.

13. A method according to claim 1, wherein the separating of the portion of the workpiece that is greater than the thickness of said three-dimensional surface element that is to be produced is effected by grinding, planing or finishing of the remaining material.

14. A method according to claim 1, wherein the separating of the portion of the workpiece that is greater than the thickness of said three-dimensional surface element that is to be produced is effected by pulling off or softening a carrier layer that is provided with a contact adhesive.

15. A method according to claim 14, wherein a reusable tear-resistant carrier layer is utilized.

16. A method according to claim 14, wherein a plastic film is used as a meltable carrier layer.

17. A method according to claim 1, wherein said three-dimensionally, flexibly deformable surface element comprises a grooved and ground veneer for use as a decorative cover layer veneer for the manufacture of laminated wood formed parts for chairs, seat forms, inner structures for vehicles, cases, containers, musical instruments, housings for electronic equipment, loud speakers, toys or sporting devices.

18. A method according to claim 1, wherein said three-dimensionally, flexibly deformable surface element serves for a coating of front portions of a piece of furniture of chipboard or fiberboard or circular tabletop profiles, of inner claddings or control parts of automobiles, or of inner claddings of aircraft of lightweight plastic components.

19. A method according to claim 1, wherein a moisture content of wood of said workpiece or of said three-dimensional surface element is set to a wood moisture of greater than 10% prior to manufacture of the three-dimensional surface element.

20. A method according to claim 19, wherein said wood moisture is set to approximately 15–22%.

21. A method according to claim 19, wherein a fungus-inhibiting material is applied or a fire retardant is introduced during a moisturizing of said workpiece or of said three-dimensional surface element.

22. A method according to claim 1, wherein said three-dimensional surface element is heated prior to said three-dimensional deformation.

23. A method according to claim 1, wherein said three-dimensional surface element is pretreated with wood plasticizer prior to its manufacture.

24. A method according to claim 23, wherein ammonia is used as said wood plasticizer.

25. A method according to claim 1, wherein said three-dimensional surface element is treated with an impregnating resin.

* * * * *

UNITED STATES PATENT AND TRADEMARK OFFICE

CERTIFICATE OF CORRECTION

PATENT NO. : 7,131,472 B2
APPLICATION NO. : 10/477649
DATED : November 7, 2006
INVENTOR(S) : Möller It is certified that error appears in the above-identified patent and that said Letters Patent is hereby corrected as shown below:

Title page,
Item [76] should read as follows:

[76] Inventor: Achim Möller, Max-Sachs-Strasse 32,
D-01157 Dresden (DE)

Title page,
Item [57] should read as follows:

[57] ABSTRACT

A method of producing a three-dimensionally, flexibly deformable surface element of wood or wood composite material is provided. A workpiece is used having a thickness at least 5% greater than the thickness of a three-dimensional surface element that is to be produced. Narrow, spaced-apart grooves are introduced into the workpiece and have a depth greater than or the same as the thickness of the three-dimensional surface element yet less than the thickness of the workpiece. The portion of the workpiece that is greater than the thickness of the surface element is separated or otherwise processed from the remainder of surface element in such a way that at least temporarily no fixed cohesion of portions separated by the grooves exist. Prior to, during or after separation from the workpiece the portions thereof separated from one another by the grooves are fixed to one another and/or to a substrate by a transverse connection or bond.

Signed and Sealed this

Ninth Day of December, 2008

JON W. DUDAS
*Director of the United States Patent and Trademark Office*